US011551844B2

(12) United States Patent
Yamamoto

(10) Patent No.: US 11,551,844 B2
(45) Date of Patent: Jan. 10, 2023

(54) LAYERED ELECTRONIC COMPONENT

(71) Applicant: Murata Manufacturing Co., Ltd., Kyoto-fu (JP)

(72) Inventor: Makoto Yamamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 406 days.

(21) Appl. No.: 15/875,358

(22) Filed: Jan. 19, 2018

(65) Prior Publication Data

US 2018/0218822 A1 Aug. 2, 2018

(30) Foreign Application Priority Data

Jan. 27, 2017 (JP) ..... JP2017-013268

(51) Int. Cl.

| | |
|---|---|
| ***H01F 17/00*** | (2006.01) |
| ***H01F 41/04*** | (2006.01) |
| ***H01F 27/30*** | (2006.01) |
| ***H01F 41/16*** | (2006.01) |
| ***H01F 1/36*** | (2006.01) |
| ***H01F 3/14*** | (2006.01) |
| *H01F 27/29* | (2006.01) |

(52) U.S. Cl.

CPC ..... *H01F 17/0013* (2013.01); *H01F 1/36* (2013.01); *H01F 3/14* (2013.01); *H01F 27/30* (2013.01); *H01F 41/04* (2013.01); *H01F 41/046* (2013.01); *H01F 41/16* (2013.01); *H01F 27/292* (2013.01); *H01F 41/043* (2013.01)

(58) Field of Classification Search

CPC ..... H01F 17/0013; H01F 27/30; H01F 1/36; H01F 27/28

USPC ..... 336/200, 232

See application file for complete search history.

(56) References Cited

U.S. PATENT DOCUMENTS

2009/0184794 A1* 7/2009 Tsuzuki ..... H01F 17/0013 336/200
2012/0188046 A1* 7/2012 Matsuura ..... H01F 27/29 336/199
2013/0038419 A1* 2/2013 Kobayashi ..... H01F 1/24 336/200

(Continued)

FOREIGN PATENT DOCUMENTS

JP 2012160506 A * 8/2012 ..... H01F 17/00
JP 2013236050 A 11/2013

(Continued)

OTHER PUBLICATIONS

An Office Action; "Notification of Reasons for Refusal," mailed by the Japanese Patent Office dated Mar. 5, 2019, which corresponds to Japanese Patent Application No. 2017-013268 and is related to U.S. Appl. No. 15/875,358; with English language translation.

*Primary Examiner* — Tszfung J Chan

(74) *Attorney, Agent, or Firm* — Studebaker & Brackett PC

(57) ABSTRACT

A layered electronic component includes a multilayer body having a metallic magnetic material layer including metallic magnetic material particles and a coil being built in the multilayer body. The coil is formed of multiple conductor patterns spirally connected each other and stacked along an axis direction of the coil, and the multilayer body includes a nonmagnetic ferrite part arranged at least an inner area of the coil when viewed from a winding axis direction of the coil.

11 Claims, 7 Drawing Sheets

(56) References Cited

U.S. PATENT DOCUMENTS

| | | | | |
|---|---|---|---|---|
| 2015/0294780 | A1* | 10/2015 | Maeda | H01F 17/0013 336/200 |
| 2016/0078997 | A1* | 3/2016 | Son | H01F 17/0033 174/260 |
| 2016/0293321 | A1* | 10/2016 | Takeoka | H01F 27/255 |
| 2017/0140864 | A1* | 5/2017 | Arai | H01F 1/28 |
| 2017/0372829 | A1* | 12/2017 | Nagai | H01F 27/255 |
| 2018/0166199 | A1* | 6/2018 | Hachiya | H01F 27/292 |

FOREIGN PATENT DOCUMENTS

| | | | | | |
|---|---|---|---|---|---|
| JP | 201453396 | A | | 3/2014 | |
| JP | 2014053396 | A | * | 3/2014 | |
| JP | 2014060289 | A | * | 4/2014 | |
| JP | 2016-051752 | A | | 4/2016 | |
| WO | WO-2010084677 | A1 | * | 7/2010 | H01F 17/0013 |
| WO | WO-2014092114 | A1 | * | 6/2014 | H01F 17/0013 |
| WO | WO-2016031999 | A1 | * | 3/2016 | H01F 17/00 |

* cited by examiner

LAYERED ELECTRONIC COMPONENT

CROSS-REFERENCE TO RELATED APPLICATION

This application claims benefit of priority to Japanese Patent Application No. 2017-013268, filed Jan. 27, 2017, the entire content of which is incorporated herein by reference.

BACKGROUND

Technical Field

The present disclosure relates to a layered electronic component.

Background Art

Multilayer inductors stacking insulation layers and conductor patterns in which the conductor patterns between the insulation layers are connected in spiral form and are superimposed in the stacking direction within a multilayer body to form a circling coil have been known. According to the progress of down-sized mobile equipment with enhanced performances, a demand for smaller and thinner multilayer inductors has increased. In addition, equipment driving with small voltage requires the multilayer inductors to have improved DC superposition characteristics and low loss.

The layered electronic component according to Japanese Unexamined Patent Application Publication No. 2016-051752 includes metallic magnetic material layers formed by using metallic magnetic material particles, conductor patterns forming a coil in the multilayer body by connecting each other in spiral form, and glass based nonmagnetic materials arranged between the conductor patterns. The above structure enables the layered electronic component to achieve both high DC superposition characteristics and low loss.

SUMMARY

Producing a layered electronic component by heating metallic magnetic materials with glass ingredient being mixed has a risk to cause characteristics degradation due to diffusion of the glass ingredient in the metallic magnetic materials in some cases. An object according to the present disclosure is to provide a layered electronic component including metallic magnetic materials which suppresses characteristics degradation in manufacturing and can achieve both high DC superposition characteristics and low loss.

According to a preferred embodiment of the present disclosure, a layered electronic component includes a multilayer body having metallic magnetic material layers including metallic magnetic material particles and a coil being built in the multilayer body. The coil is formed of multiple conductor patterns spirally connected each other and stacked along a winding axis direction of the coil, and the multilayer body includes nonmagnetic ferrite parts arranged at least an inner area of the coil when viewed from the winding axis direction of the coil.

Other features, elements, characteristics and advantages of the present disclosure will become more apparent from the following detailed description of preferred embodiments of the present disclosure with reference to the attached drawings.

DETAILED DESCRIPTION

Figure 1:
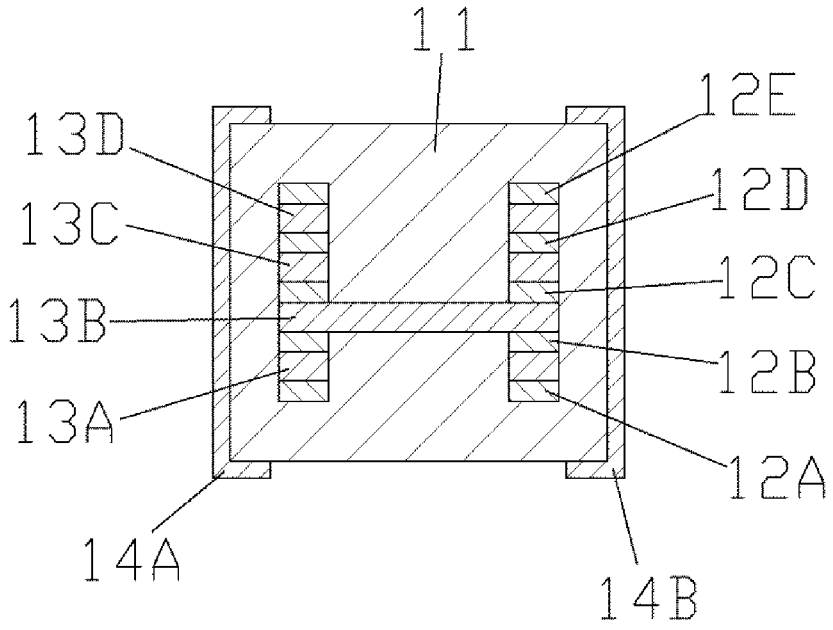
FIG. 1 is a cross sectional view illustrating a first example of a layered electronic component according to an embodiment of the present disclosure.

A layered electronic component includes a multilayer body having metallic magnetic material layers including metallic magnetic material particles and a coil being built in the multilayer body. The coil is formed of multiple conductor patterns spirally connected each other and stacked along a winding axis direction of the coil. The multilayer body includes nonmagnetic ferrite parts arranged at least at an inner area of the coil when viewed from the winding axis direction of the coil. As described above, layered electronic components use a metallic magnetic material with high maximum magnetic flux density in the multilayer body and form a magnetism gap at least at a part of a magnetic path in the multilayer body by a nonmagnetic ferrite part. The nonmagnetic ferrite part enables a layered electronic component to control the magnetic flux from the coil and the multilayer body to be hard to be magnetically saturated. The above enables a layered electronic component to achieve both high DC superposition characteristics and low loss and to further suppress lowering withstand voltage and inductance. In addition, since glass is not used for the structure of the multilayer body, lowering withstand voltage and inductance can be suppressed. Since higher inductance allows a shorter conductor pattern, direct current resistance (DCR) is lowered and thus power loss can be lowered.

The nonmagnetic ferrite parts formed in the multilayer body are arranged at the inner area of the coil when viewed from the winding axis direction of the coil to intersect the magnetic flux generated by the coil and passing through inside the coil. The nonmagnetic ferrite part may be arranged at least at an inner side of the coil or on an extending area thereof. That is, the ferrite part may be arranged inside the coil or may be circumscribed to at least one end portion of the coil.

The nonmagnetic ferrite part has a substantially layered shape and is orthogonal to the winding axis direction of the coil, and an outer peripheral part of the nonmagnetic ferrite part may be exposed to the surface of the multilayer body. This makes it possible to effectively control the magnetic flux of the coil and to achieve higher DC superposition characteristics.

The nonmagnetic ferrite part may be arranged across the coil. This makes it possible to effectively control the magnetic flux of the coil and to achieve higher DC superposition characteristics. A nonmagnetic ferrite part may be further arranged between the stacked conductor patterns. This makes it possible to achieve excellent withstand voltage.

The volume average particle diameter of the metallic magnetic material particles may be larger than the distance between stacked conductor patterns. This makes it possible to achieve higher DC superposition characteristics and withstand voltage. Further, since the distance between each conductor pattern can be short, smaller and thinner layered electronic component can be configured.

The nonmagnetic ferrite part may be arranged to touch at least one end portion of the coil. This makes it possible to effectively control the magnetic flux of the coil and to achieve higher DC superposition characteristics.

Embodiments of the present disclosure will be explained below according to the drawings. However, embodiments described below merely illustrate examples of layered electronic components for realizing the technical idea of the present disclosure, and the present disclosure does not limit layered electronic components illustrated below. Note that members illustrated in aspects of the present disclosure are never limited to the members illustrated in the embodiments. Especially, the size, material, shape and relative arrangement and the like of structure components according to the embodiments do not limit the scope of the present disclosure otherwise specifically noted, and merely illustrate examples for the explanation. Identical reference signs are used for the identical portions in each drawing. Although, disclosed embodiments are divided and explained for the sake of the explanation or clarity, partial replacement or combination of configurations disclosed in the different embodiments is possible.

EXAMPLES

FIG. 1 is a schematic cross sectional view illustrating a first example of a layered electronic component. In FIG. 1, 11 is a multilayer body, 12A to 12E are conductor patterns, 13A to 13D are nonmagnetic ferrite parts, and 14A and 14B are outer terminals. The layered electronic component can be used as an inductor, for example.

Figure 7:
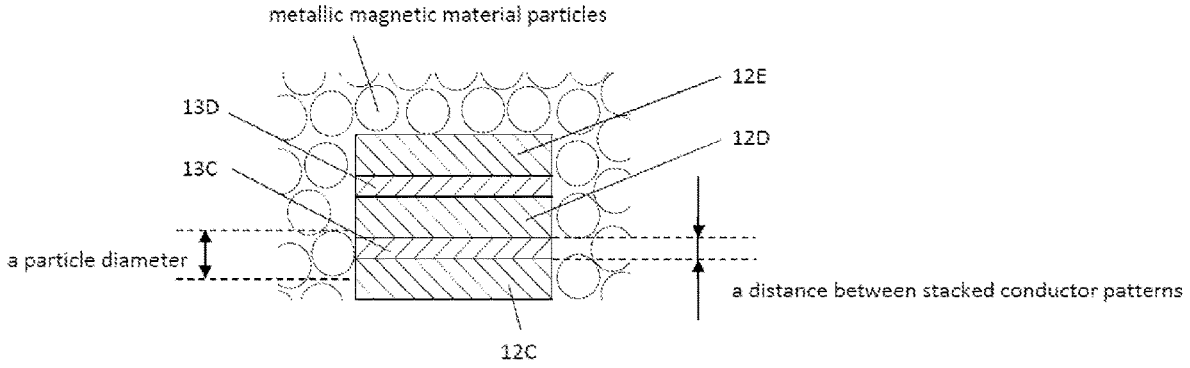
FIG. 7 is a is a cross sectional view illustrating metallic magnetic material particles of an exemplary layered electronic component according to an embodiment of the present disclosure.

The multilayer body 11 is formed by stacking metallic magnetic material layers, the conductor patterns 12A to 12E, and the nonmagnetic ferrite parts 13A to 13D. The metallic magnetic material layers are formed by using metallic magnetic material particles such as metallic magnetic alloy powder including iron and silicon, metallic magnetic alloy powder including iron, silicon and chromium, and metallic magnetic alloy powder including iron, silicon and an element easy to be oxidized than iron. The volume average particle diameter of the metallic magnetic material particles can be larger than the distance between stacked conductor patterns, for example, as shown in FIG. 7

The conductor patterns 12A to 12E forming the coil, for example, are formed by using conductor paste including conductive metallic materials in paste form such as silver, silver-based alloy, gold, gold-based alloy, copper, and copper-based alloy, etc. In FIG. 1, stacked conductor patterns are insulated by nonmagnetic ferrite parts formed therebetween. The stacked conductor patterns 12A to 12E are spirally connected to form the coil in the multilayer body 11 by using interlayer connection conductors penetrating the nonmagnetic ferrite parts, for example. The nonmagnetic ferrite part 13A is arranged between the conductor pattern 12A and the conductor pattern 12B, and the nonmagnetic ferrite part 13B is arranged between the conductor pattern 12B and the conductor pattern 12C, and the nonmagnetic ferrite part 13C is arranged between the conductor pattern 12C and the conductor pattern 12D, and the nonmagnetic ferrite part 13D is arranged between the conductor pattern 12D and the conductor pattern 12E. The nonmagnetic ferrite parts 13A to 13D are formed by using Zn ferrite or Cu—Zn ferrite, for example. The volume average particle diameter of the structural material for the nonmagnetic ferrite part can be smaller than the volume average particle diameter of the metallic magnetic material particles. Further, the nonmagnetic ferrite parts 13A, 13C and 13D are formed between the conductor patterns forming the upper/lower coils and are substantially shaped following the shape of the conductor patterns. In addition, the nonmagnetic ferrite part 13B is formed in a substantially layered shape and is orthogonal to the winding axis direction of the coil. The nonmagnetic ferrite part 13B is formed across the entire area including a range from an outer peripheral part of the conductor patterns to the inner partial area so as to across the winding axis portion of the coil. In FIG. 1, only one layer of the nonmagnetic ferrite part 13B is formed; however, multiple nonmagnetic ferrite parts may be formed within the inner area of the coil.

The multilayer body 11 formed by stacking the metallic magnetic material layers, conductor patterns, and the nonmagnetic ferrite parts is debindered in the atmosphere at a predetermined temperature (for example, about 350° C.) and fired (for example, about 750° C. in the atmosphere). Glass is used in place of the nonmagnetic ferrite in the known art. In the above case, a softening point of glass need to be at equal to or lower than the firing temperature to secure the strength for forming a structure body (for example, in the case of the firing temperature being about 750° C., a softening point being about 720° C.). Consequently, diffusion of glass ingredient from boundary surface of glass which is contacting to the metallic magnetic material particles cannot be avoided. The diffusion of glass ingredient to the metallic magnetic material particles can cause lowering insulation characteristics and generating characteristics degradation. On the contrary, in a case of using the nonmagnetic ferrite instead of the glass ingredient, unnecessary diffusion of ingredient in the firing process does not occur, and thus characteristics degradation is suppressed.

Outer terminals 14A and 14B are formed at both end surfaces of the multilayer body 11. Each of both end portions of the coil is connected to each of both of the outer terminals 14A and 14B. The outer terminals 14A and 14B can be formed after the firing process of the multilayer body 11, for example. In the above case, for example, the outer terminals 14A and 14B can be formed by baking (for example, about 650° C.) the multilayer body 11 after applying conductor paste for the outer terminal to both end portions of the multilayer body 11. Further, the outer terminals 14A and 14B can be formed by plating the baked conductors formed by baking the multilayer body 11, after applying conductor paste for the outer terminal to both the end portions of the multilayer body 11. In the above case, hollows present in the multilayer body 11 may be impregnated with resin in advance to prevent intrusion of a plating solution.

Figure 2:
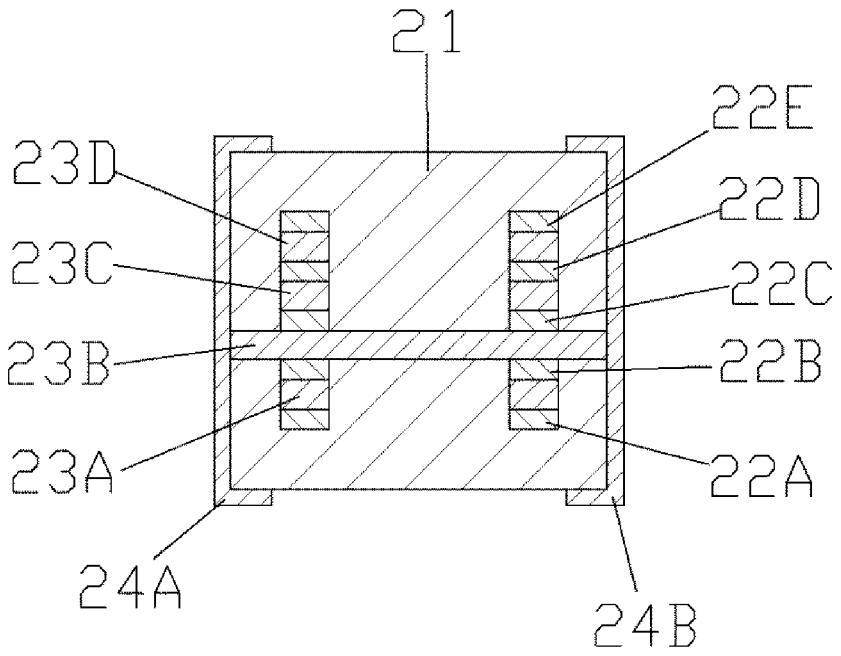
FIG. 2 is a cross sectional view illustrating a second example of the layered electronic component according to an embodiment of the present disclosure.

FIG. 2 is a schematic cross sectional view illustrating a second example of the layered electronic component. In FIG. 2, 21 is a multilayer body, 22A to 22E are conductor patterns, 23A to 23D are nonmagnetic ferrite parts, and 24A and 24B are outer terminals. In the second example, the outer peripheral part of the substantially layer shaped nonmagnetic ferrite part 23B is exposed to the side surface of the multilayer body 21.

The multilayer body 21 is formed by stacking metallic magnetic material layers, the conductor patterns 22A to 22E, and nonmagnetic ferrite parts 23A to 23D. The metallic magnetic material layers are formed by using metallic magnetic material particles such as metallic magnetic alloy powder including iron and silicon, metallic magnetic alloy powder including iron, silicon and chromium, and metallic magnetic alloy powder including iron, silicon and an element easy to be oxidized than iron. The volume average particle diameter of the metallic magnetic material particles can be larger than the distance between stacked conductor patterns, for example, as shown in FIG. 7.

The conductor patterns 22A to 22E forming the coil, for example, are formed by using conductor paste including conductive metallic materials in paste form such as silver, silver-based alloy, gold, gold-based alloy, copper, copper-based alloy, etc. In FIG. 2, stacked conductor patterns are insulated by nonmagnetic ferrite parts formed therebetween. The stacked conductor patterns 22A to 22E are spirally connected to form the coil in the multilayer body 21 by using interlayer connection conductors penetrating the nonmagnetic ferrite parts, for example. The nonmagnetic ferrite part 23A is arranged between the conductor pattern 22A and the conductor pattern 22B, and the nonmagnetic ferrite part 23B is arranged between the conductor pattern 22B and the conductor pattern 22C, and the nonmagnetic ferrite part 23C is arranged between the conductor pattern 22C and the conductor pattern 22D, and the nonmagnetic ferrite part 23D is arranged between the conductor pattern 22D and the conductor pattern 22E. The nonmagnetic ferrite parts 23A to 23D are formed by using Zn ferrite or Cu—Zn ferrite, for example. The volume average particle diameter of the structural material forming the nonmagnetic ferrite part can be smaller than the volume average particle diameter of the metallic magnetic material particles. Further, the nonmagnetic ferrite parts 23A, 23C and 23D are formed between the conductor patterns forming the upper/lower coils and are substantially shaped following the shape of the conductor patterns. In addition, the nonmagnetic ferrite part 23B is formed in substantially a layered shape and is orthogonal to the winding axis direction of the coil. The nonmagnetic ferrite part 23B is formed to across the winding axis portion of the coil and to expose the outer peripheral part to the side surface of the multilayer body 21.

Outer terminals 24A and 24B are formed at both the end surfaces of the multilayer body 21. Each of both the end portions of the coil is connected to both of the outer terminals 24A and 24B. The forming method of the outer terminals 24A and 24B is similar to that of the first example.

Figure 3:
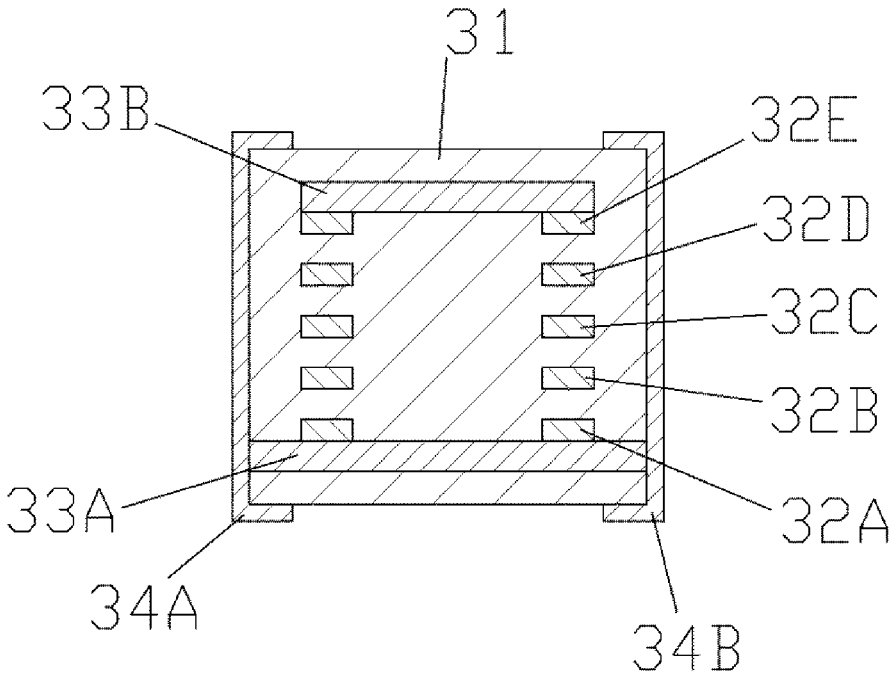
FIG. 3 is a cross sectional view illustrating a third example of the layered electronic component according to an embodiment of the present disclosure.

FIG. 3 is a schematic cross sectional view illustrating a third example of the layered electronic component. In FIG. 3, 31 is a multilayer body, 32A to 32E are conductor patterns, 33A and 33B are nonmagnetic ferrite parts, and 34A and 34B are outer terminals. In the third example, each of the nonmagnetic ferrite parts 33A and 33B is arranged outside the coil, and is circumscribed to both the end portions of the coil.

The multilayer body 31 is formed by stacking metallic magnetic material layers, the conductor patterns 32A to 32E, and the nonmagnetic ferrite parts 33A and 33B. The metallic magnetic material layers are formed by using metallic magnetic material particles such as metallic magnetic alloy powder including iron and silicon, metallic magnetic alloy powder including iron, silicon and chromium, and metallic magnetic alloy powder including iron, silicon and an element easy to be oxidized than iron.

The conductor patterns 32A to 32E forming the coil, for example, are formed by using conductor paste including conductive metallic materials in paste form such as silver, silver-based alloy, gold, gold-based alloy, copper, copper-based alloy, etc. In FIG. 3, stacked conductor patterns are insulated by metallic magnetic material layers formed therebetween. The stacked conductor patterns 32A to 32E are spirally connected to form the coil in the multilayer body 31 by using interlayer connection conductors penetrating the metallic magnetic material layers, for example. The nonmagnetic ferrite part 33A is arranged to be circumscribed to the conductor pattern 32A as one end portion of the coil, and the nonmagnetic ferrite part 33B is arranged to be circumscribed to the conductor pattern 32E as the other end portion of the coil. The nonmagnetic ferrite parts 33A to 33B are formed by using Zn ferrite or Cu—Zn ferrite, for example. The nonmagnetic ferrite parts 33A and 33B are formed in substantially a layered shape and are orthogonal to the winding axis direction of the coil and formed outside the coil. The nonmagnetic ferrite part 33A is formed to expose the outer peripheral part thereof to the side surface of the multilayer body 31 and is circumscribed to one end portion of the coil. The nonmagnetic ferrite part 33B is formed across the entire area including a range from an outer peripheral part of the conductor patterns to the inner partial area and is circumscribed to the other end portion of the coil. Although each of the nonmagnetic ferrite parts 33A and 33B directly contacts to an end portion of the coil in FIG. 3, the metallic magnetic material layers may be interposed therebetween.

Figure 4:
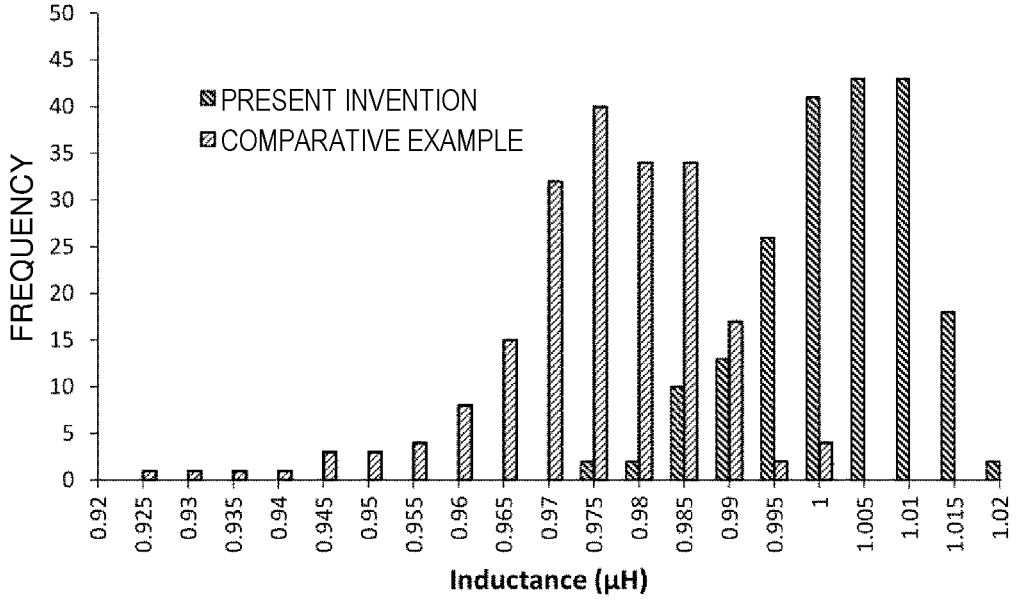
FIG. 4 is a chart comparing inductance of the layered electronic component according to an embodiment of the present disclosure and inductance of a layered electronic component of a comparative example.
Figure 5:
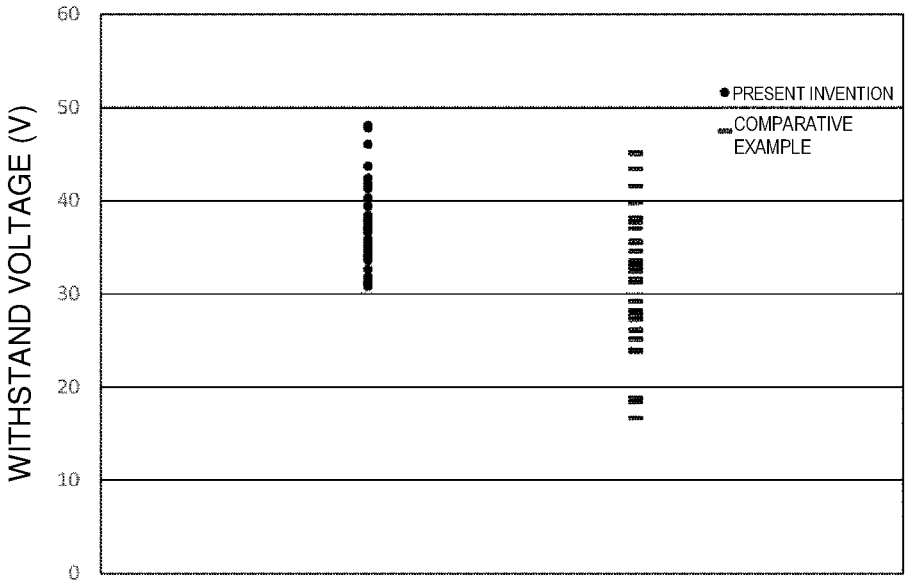
FIG. 5 is a chart comparing withstand voltage of the layered electronic component according to an embodiment of the present disclosure and withstand voltage of a layered electronic component of a comparative example.
Figure 6:
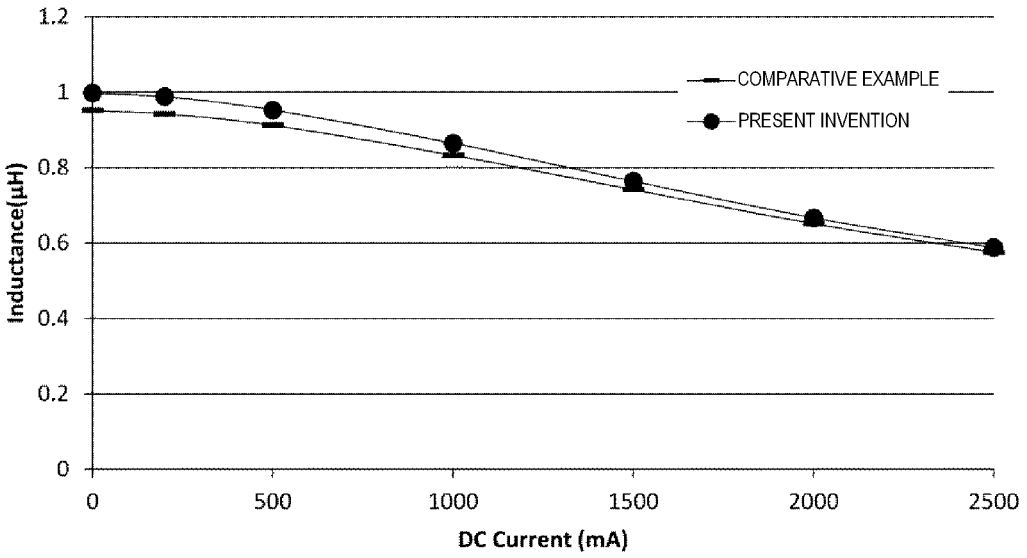
FIG. 6 is a chart comparing DC superposition characteristics of the layered electronic component according to an embodiment of the present disclosure and DC superposition characteristics of a layered electronic component of a comparative example.

The layered electronic component of the present disclosure is compared with a comparative example having an identical structure state and designed to be initial inductance value being 1 μH (for example, a known layered electronic component using alumina and glass according to Japanese Unexamined Patent Application Publication No. 2016-051752). The results are illustrated in FIG. 4 to FIG. 6. FIG. 4 is a bar graph comparing variations in inductance value in the present disclosure and in the comparative example, and the horizontal axis indicates inductance value, and the vertical axis indicates frequency. FIG. 5 is a scatter diagram comparing withstand voltage in the present disclosure and withstand voltage in a comparative example, and the vertical axis indicates the withstand voltage. FIG. 6 is a curved graph comparing DC superposition characteristics of the present disclosure and that of a comparative example, and the vertical axis indicates an inductance value, and the horizontal axis indicates a current value flowing through a layered electronic component. Note that, the inductance value is measured by an LCR meter 4285A and the withstand voltage is measured by a testing machine manufactured by Murata Manufacturing Co., Ltd. As illustrated in FIG. 4, the layered electronic component of the comparative example has a lower inductance value in comparison with the layered electronic component of the present disclosure. As illustrated in FIG. 5, the layered electronic component of the comparative example has lower withstand voltage in comparison with the layered electronic component of the present disclosure. As illustrated in FIG. 6, the layered electronic component of the present disclosure has similar DC superposition characteristics in comparison with the layered electronic component of the comparative example. As a result, the multilayer inductor according to the present disclosure achieves both high DC superposition characteristics and low loss, and further can suppress lowering withstand voltage and an inductance value.

Although examples of the layered electronic component according to the present disclosure are described thus far, the present disclosure is not limited to the examples. For example, the metallic magnetic material layers may be formed using such as metallic magnetic alloy powder including iron and silicon, or metallic magnetic alloy powder including iron, silicon and chromium, by being doped with an element easy to be oxidized than iron. Further, thickness, position, and the number of the nonmagnetic ferrite parts can be changed according to the desired characteristics.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A layered electronic component comprising:

a multilayer body having a metallic magnetic material layer including metallic magnetic material particles; and a coil in the multilayer body, the coil being formed of multiple conductor patterns spirally connected each other and stacked along a winding axis direction of the coil, and the multilayer body including a first nonmagnetic ferrite part arranged at least an inner area of the coil when viewed from the winding axis direction of the coil, wherein the metallic magnetic material layer does not contain glass, and the first nonmagnetic ferrite part does not contain glass, a volume average particle diameter of a structural material of the first nonmagnetic ferrite part is smaller than a volume average particle diameter of the metallic magnetic material particles, and only two nonmagnetic ferrite parts are in the layered electronic component, the first nonmagnetic ferrite part being arranged at one end of the coil in the winding axis direction, and a second nonmagnetic part being arranged at an end of the coil opposite the first nonmagnetic part, and wherein an outer peripheral part of the second nonmagnetic ferrite part is exposed to an outer side surface of the multilayer body.

2. The layered electronic component according to claim 1, wherein the first nonmagnetic ferrite part has a substantially layered shape and is orthogonal to the winding axis direction of the coil, and an outer peripheral part of the first nonmagnetic ferrite part is exposed to a surface of the multilayer body.

3. The layered electronic component according to claim 1, wherein the first nonmagnetic ferrite part is arranged across the coil.

4. The layered electronic component according to claim 1, wherein a diameter of a particle having the volume average particle diameter of the metallic magnetic material particles is larger than a distance between stacked conductor patterns.

5. The layered electronic component according to claim 1, wherein the first nonmagnetic ferrite part is in contact with at least one end portion of the coil.

6. The layered electronic component according to claim 2, wherein the first nonmagnetic ferrite part is arranged across the coil.

7. The layered electronic component according to claim 2, wherein a diameter of a particle having the volume average particle diameter of the metallic magnetic material particles is larger than a distance between stacked conductor patterns.

8. The layered electronic component according to claim 3, wherein a diameter of a particle having the volume average particle diameter of the metallic magnetic material particles is larger than a distance between stacked conductor patterns.

9. The layered electronic component according to claim 6, wherein a diameter of a particle having the volume average particle diameter of the metallic magnetic material particles is larger than a distance between stacked conductor patterns.

10. The layered electronic component according to claim 2, wherein the first nonmagnetic ferrite part is in contact with at least one end portion of the coil.

11. A layered electronic component comprising:

a multilayer body having a metallic magnetic material layer including metallic magnetic material particles; and a coil in the multilayer body, the coil being formed of multiple conductor patterns spirally connected each other and stacked along a winding axis direction of the coil, wherein the multilayer body includes:

a first nonmagnetic ferrite part that is arranged at least an inner area of the coil, arranged to overlap the coil, and does not extend to an outer area of the coil when viewed from the winding axis direction of the coil; and a second nonmagnetic ferrite part that is arranged at least an inner area of the coil, arranged to be overlapped by the coil, and extended to an outer area of the coil when viewed from the winding axis direction of the coil, and wherein the first nonmagnetic ferrite part is attached to an uppermost surface of the stacked conductor patterns, and the second nonmagnetic ferrite part is attached to a lowermost surface of the stacked conductor patterns.

* * * * *